US010660483B2

(12) United States Patent
Hyde

(10) Patent No.: US 10,660,483 B2
(45) Date of Patent: May 26, 2020

(54) SOAP WITH FINGER STRAP ATTACHED AND METHOD FOR FABRICATING SAME

(71) Applicant: Geoffrey Scott Hyde, Montgomeryville Village, MD (US)

(72) Inventor: Geoffrey Scott Hyde, Montgomeryville Village, MD (US)

( * ) Notice: Subject to any disclaimer, the term of this patent is extended or adjusted under 35 U.S.C. 154(b) by 0 days.

(21) Appl. No.: 16/147,698

(22) Filed: Sep. 29, 2018

(65) Prior Publication Data

US 2019/0029475 A1 Jan. 31, 2019

Related U.S. Application Data

(63) Continuation-in-part of application No. 14/757,113, filed on Nov. 23, 2015, now abandoned.

(51) Int. Cl.

| | |
|---|---|
| ***A47K 7/00*** | (2006.01) |
| ***C11D 13/16*** | (2006.01) |
| ***A47K 5/05*** | (2006.01) |
| ***C11D 17/04*** | (2006.01) |

(52) U.S. Cl.

CPC ..... *A47K 7/00* (2013.01); *A47K 5/05* (2013.01); *C11D 13/16* (2013.01); *C11D 17/04* (2013.01)

(58) Field of Classification Search

CPC ... A47K 5/04; A47K 5/05; A47K 7/00; C11D 17/04; C11D 17/048

USPC ..... 401/8

See application file for complete search history.

(56) References Cited

U.S. PATENT DOCUMENTS

| | | | | | |
|---|---|---|---|---|---|
| 843,330 | A * | 2/1907 | Drought | A47K 5/05 | 248/686 |
| 1,478,882 | A * | 12/1923 | Marcel | C11D 13/14 | 510/440 |
| 1,787,660 | A * | 1/1931 | Blakeley | C11D 17/041 | 401/8 |
| 2,243,634 | A * | 5/1941 | Kadish | A47K 5/05 | 401/8 |
| 2,770,071 | A * | 11/1956 | Endres | A47K 5/05 | 401/8 |
| 3,341,457 | A * | 9/1967 | Schmidt | A47K 5/05 | 510/143 |
| 3,488,126 | A * | 1/1970 | Avallone | A47K 7/03 | 401/8 |
| 4,062,792 | A * | 12/1977 | McNabb | C11D 13/04 | 510/142 |
| 4,741,852 | A * | 5/1988 | Ondracek | C11D 17/048 | 15/222 |

(Continued)

*Primary Examiner* — David P Angwin
*Assistant Examiner* — Bradley S Oliver
(74) *Attorney, Agent, or Firm* — Andra M. Vaccaro, Esq.

(57) ABSTRACT

The present invention comprises a soap which does not disengage from the user while in use and provides a means to hang the soap while not in use. Specifically, in a preferred embodiment of the present invention, a semiflexible continuous mechanical structure extends above a surface of a soap bar just enough to create an open area through which the user's finger may be removably inserted whereby the bottom portion of the structure is embedded within the body of soap 12, such that, when, in use, a user's finger may be inserted into the top portion of the structure, where it will rest atop the top surface of the soap and the bottom portion of the structure will remain substantially embedded in the soap as it dissolves. The top portion of the structure also provides a means to hang the soap while not in use.

3 Claims, 1 Drawing Sheet

(56) References Cited

U.S. PATENT DOCUMENTS

| | | | | |
|---|---|---|---|---|
| 5,071,583 | A * | 12/1991 | Martell | C11D 17/00 401/88 |
| 6,190,079 | B1 * | 2/2001 | Ruff | A47K 5/05 401/201 |
| 6,397,438 | B1 * | 6/2002 | DeWan | A44B 18/00 24/17 AP |
| 8,536,104 | B1 * | 9/2013 | Roman-Barcelo | C11D 17/048 401/8 |
| 9,603,492 | B2 * | 3/2017 | Cannata | A47K 5/05 |
| 10,070,758 | B2 * | 9/2018 | Healy | A47K 5/04 |

* cited by examiner

SOAP WITH FINGER STRAP ATTACHED AND METHOD FOR FABRICATING SAME

CROSS-REFERENCE TO RELATED APPLICATION

This patent application claims priority under 35 U.S.C. 120 to U.S. patent application Ser. No. 14/757,113 filed Nov. 23, 2015, the disclosure of which is incorporated by reference.

BACKGROUND OF THE INVENTION

The present invention relates to soap and more particularly to soaps having handles or other means for easily engaging wet soap so it does not fall during use and for having a means for hanging it to dry or when dry.

PRIOR ART

Means for hanging and engaging soap while it is being used is very well known in the art. By way of example and not limitation, when soap gets wet it can become very slippery and fall or drop from the hand of the person using it. Thus, the soap must be firmly grasped by the user to prevent unwanted disengagement of the soap and the subsequent maneuvering to find where the disengaged soap has fallen. Also, after soap is used, it is preferable to store it so that it can dry without further disintegration or having to sit in a puddle of water. Prior art devices that keep soap from falling and which can also be used to hang the soap while it is not in use include, without limitation, "soap on a rope", a "soapsock", soap containers, cleansing pads, scrubbing soap bars containing rough netting and the like. However, many of these devices are cumbersome, may disintegrate and/or otherwise fail as the soap gets wet and dissolves.

SUMMARY OF THE INVENTION

In a preferred embodiment of the present invention, a mechanical structure is embedded within a bar or other shape of soap. In a preferred embodiment the mechanical structure has a semi-flexible external portion that can be engaged by a finger or fingers of a hand of the user and an internal portion that is affixed within the soap itself. In a preferred embodiment, the external portion of the mechanical structure is fabricated out of a semiflexible material capable of expanding in size to adjust to the size of a variety of user's finger(s) and/or hand(s). The shape of the mechanical structure may be a circle, square, oval, or any other shape as long as there is an area thereof which can be engaged by the finger(s) and/or the hand of the user when a portion of the structure is embedded within the soap. In a preferred embodiment, the portion of the mechanical structure that extends outside of a hardened bar of soap comprises a semicircular loop that is configured to fit the finger(s) of a user. In an embodiment of the invention, the loop is comprised of a semiflexible material. During manufacture, the mechanical structure is partially embedded in the soap such that that an internal portion of the structure will remain substantially embedded in the hardened soap throughout the life of the soap and the remainder of the structure extends from a surface of the soap to form a loop that is engaged by the user's finger(s). The external portion also may be used to hang the soap while not in use.

In a preferred method of the present invention, soap materials are poured into a soap mold and before the soap hardens, a continuous loop made out of a semiflexible material is lowered into the non-hardened soap material so that one end of the loop is contained wholly within the soap as it hardens and the reciprocal other end of the loop extends outside of the soap, just enough so as to create a loop into which a user's finger(s) can be inserted and from which the soap may be hung when not in use.

DETAILED DESCRIPTION OF THE DRAWINGS

Figure 1:
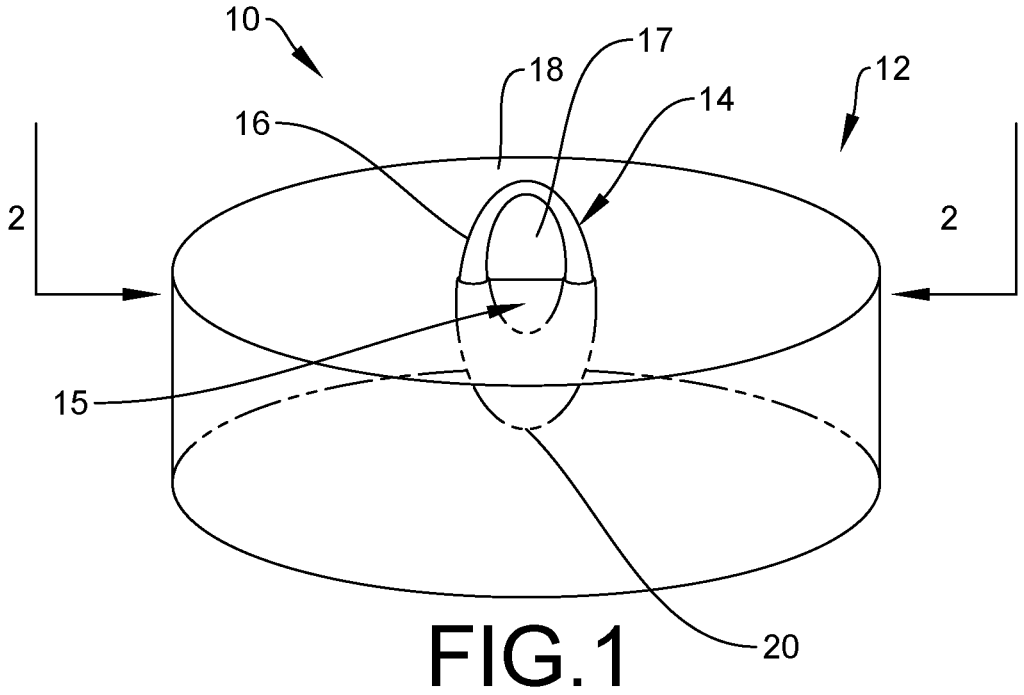
FIG. 1 is a perspective view of a preferred embodiment of the present invention.
Figure 2:
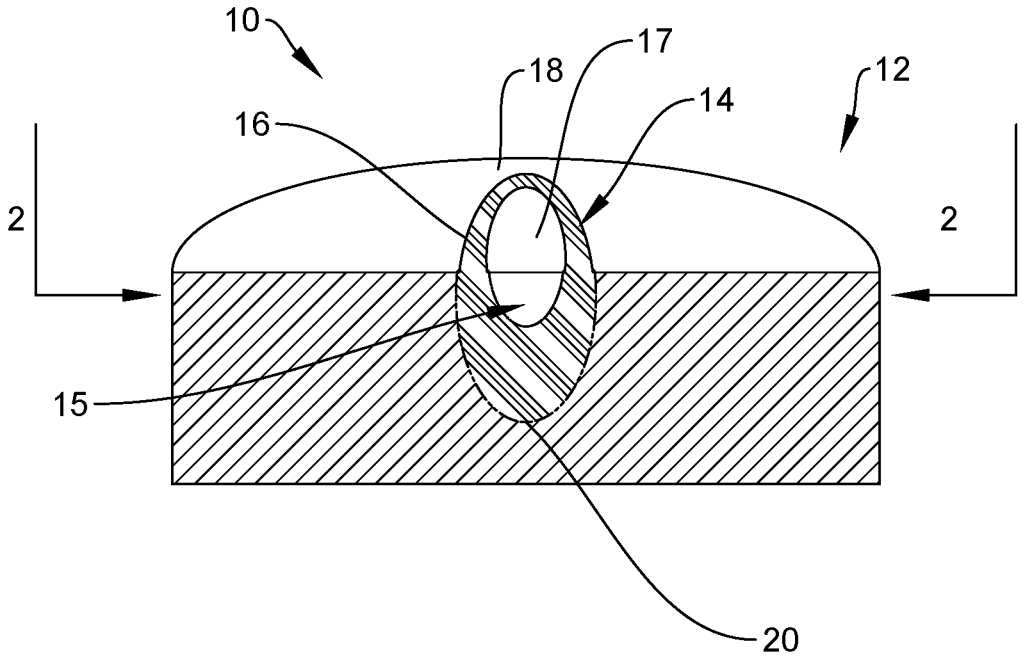
FIG. 2 is a cross sectional view of a preferred embodiment of the present invention.

Referring to FIGS. 1 and 2, a preferred embodiment of the present invention is shown in which like numerals refer to like parts. In FIG. 1, a preferred embodiment 10 of the present invention comprises a soap 12 and a mechanical structure 14 having an open area 15 therein, whereby the top 16 of the structure 14 extends above a surface 18 of the soap 12 just enough to create an area 17 for a user's finger to slip through to engage the soap 12 and rest atop of a surface 18 of soap 12 when it is in use. The bottom portion 20 of structure 14 shown by dotted lines is embedded within the body of soap 12 as shown more specifically in FIG. 2 which is a cross-sectional view of the embodiment shown in FIG. 1 taken along lines 2-2.

In a preferred embodiment 10 of the present invention, the mechanical structure 14 comprises a relatively small semi-flexible structure. In a preferred embodiment structure 14 is shaped as a substantially elongated "0" to create an inner loop 17 although other shapes may be used, such as a figure "8," a circle, a semicircle, an anvil-shape, lollipop-shape or any other shape whereby the bottom portion 20 of the structure 14 can be fully embedded within the soap 12 during fabrication thereof and a top portion 16 of the structure 14 can extend just far enough above the surface 18 of the soap 12 to create a loop 17 through which a finger of the user easily can be inserted and thereafter easily removed without destroying the structure 14 or the soap 12.

In a preferred embodiment 10 of the present invention, the structure 14 is fabricated out of semi-flexible smooth surfaced material. The material is selected so as not to irritate or exfoliate the skin, finger or hand of the user while the soap is being used. In a preferred embodiment, the structure 14 may be fabricated out of an organic rubber, although other materials such as silk, polyester, linen, cotton, bamboo and any other semi-flexible or semi-rigid material can be used, the only limitation being that it must be of sufficient flexibility and thickness for at least one finger of a generic user to slip through tightly enough to rest atop surface 18 of soap 12 to engage the soap 12 to prevent the soap 12 from falling from the user's hand during use. In addition, the bottom portion 20 of structure 14 must be of sufficient thickness so that it does not decompose, fray or break as the soap disintegrates but also not come into contact with the user's skin for most of the life of the soap 12 while it disintegrates from use. In addition, the loop 17 can be used to hang the soap when the soap is not in use.

In FIG. 2, a cross-section of the device 10 is shown along the lines 2-2 of FIG. 1, whereby the structure 14, is comprised of substantially a loop. In FIG. 2, top 16 of loop 17 extends above the surface 18 of the soap 12 and the bottom 20 of the loop 17 is embedded within the soap 12 below the surface 18 at a depth sufficient to ensure that the embedded portion 20 of the structure 14 forming the loop 17 does not come into contact with the skin of the user until the soap has substantially been used. In addition, due to the material from which the structure 14 is fabricated, if the loop 17 comes into contact with the skin of the user as the soap dissolves, it will not substantially irritate the user.

In a preferred method of the present invention, the device 10 is fabricated by slipping the finger holding portion of the mechanical structure 14 onto a holder (not shown) which is then placed over a soap mold (not shown). After the soap material is poured into the mold, before the soap substantially hardens, the holder onto which the loop 17 has been placed is lowered such that the bottom portion 20 of the loop 14 is embedded into the soap 12 just enough so that the top 16 of the loop 17 forms an area above the top surface 18 of the soap 12 sufficient for engagement of a finger(s). The soap 12 is then left to harden at which time the soap is removed. The loop 17 can also be used to hang the soap for drying while not in use.

In a preferred method of the present invention, the holder (not shown) used during the fabrication process is a pole having an outer diameter substantially equivalent to the inner diameter of the top 16 of loop 17.

Using a preferred embodiment of the present invention, a user inserts his/her finger through the loop 14 that extends above the top surface 18 of the soap 12, such that the hand and fingers of the user may rest along the top surface 18 of the soap 12. Using the present invention, when the soap becomes wet and/or slippery, the soap will not disengage from the user.

The presently disclosed embodiments are to be considered in all respects as illustrative and not restrictive, the scope of the invention being indicated by the appended claims rather than the foregoing description, and all changes which come within the meaning and range of equivalency of the claims are therefore intended to be embraced therein. The embodiments and methods described above are exemplary embodiments and methods of the present invention. And while these particular embodiments and techniques of the present invention have been shown and illustrated herein, it will be understood that many changes, substitutions and/or modifications may be made by those persons skilled in the art. It will be appreciated from the above description of presently preferred embodiments and techniques that other configurations and techniques are possible and within the scope of the present invention. Thus, the present invention is not intended to be limited to the particular embodiments and techniques specifically discussed hereinabove.

The invention claimed is:

1. A soap that will remain engaged by the user when it is wet, comprising, a semiflexible continuous oval-shaped non-abrasive structure, consisting of:

a handle structure consisting of an outer oval of a semiflexible non-abrasive material with a large circumference and an inner oval which defines an opening with a relatively smaller circumference located proximate the top of the outer oval, wherein the handle structure is partially embedded within the soap so as to create a top loop portion that extends over the top surface of the soap to create a substantially C-shaped loop which defining structure gains girth as it approaches the surface of the soap; and an embedded loop portion, of substantially thicker and wider girth than the loop portion, that remains wholly embedded within the soap during use, whereby when the soap is being used, the user's finger is inserted into the substantially C-shaped loop so that it is held therein and causes the hand of the user to rest against the top surface of the soap so that the soap cannot be disengaged from the user while in use, and the embedded portion of the handle structure holds the loop in place while the soap is being used.

2. The soap of claim 1, wherein the entire semiflexible continuous oval-shaped non-abrasive structure is wholly comprised of organic rubber.

3. The soap of claim 1, wherein the handle structure is comprised of silk, polyester, linen, cotton, bamboo or any other semi-rigid material that has sufficient flexibility and thickness for at least one finger of the user to slip through tightly enough to rest atop the top surface of the soap.

* * * * *